US005392928A

United States Patent [19]

Nickey et al.

[11] Patent Number: 5,392,928

[45] Date of Patent: Feb. 28, 1995

[54] INSPECTION AND SORTING OF CONTAINERS

[75] Inventors: George A. Nickey, Maumee; John K. Moore, Perrysburg; Mark R. Tipping, Maumee, all of Ohio

[73] Assignee: Owens-Illinois Glass Container Inc., Toledo, Ohio

[21] Appl. No.: 95,459

[22] Filed: Jul. 22, 1993

[51] Int. Cl.[6] ..... B07C 5/00

[52] U.S. Cl. ..... 209/643; 209/523; 209/583; 209/905; 209/913; 198/459; 198/467.1

[58] Field of Search ..... 209/522, 523, 524, 559, 209/564, 583, 643, 905, 912, 913; 198/340, 372, 438, 459, 467.1

[56] References Cited

U.S. PATENT DOCUMENTS

| | | | |
|---|---|---|---|
| 2,800,226 | 7/1957 | Drennan | 209/528 |
| 3,279,599 | 10/1966 | Drennan | 209/643 X |
| 3,351,198 | 11/1967 | Wyman | 209/528 |
| 4,044,227 | 8/1977 | Holm et al. | 209/583 X |
| 4,230,219 | 10/1980 | Pezzin et al. | 198/480.1 X |
| 4,413,738 | 11/1983 | Pemberton et al. | 209/523 |
| 4,660,708 | 4/1987 | Willerding | 198/459 X |
| 4,691,830 | 9/1987 | Ahl et al. | 209/523 |
| 4,760,909 | 8/1988 | Dudley et al. | 209/643 X |
| 4,762,544 | 8/1988 | Davey | 209/583 X |
| 4,879,025 | 11/1989 | Shapcott | 209/559 |
| 4,915,237 | 4/1990 | Chang et al. | 209/524 |

FOREIGN PATENT DOCUMENTS

| | | | |
|---|---|---|---|
| 0227679 | 9/1985 | Germany | 209/524 |

*Primary Examiner*—D. Glenn Dayoan
*Assistant Examiner*—Tuan N. Nguyen

[57] ABSTRACT

A system for inspecting and sorting molded containers, such as glass bottles that includes a finished product inspection station for inspecting containers transported in sequence along a predetermined path, identifying containers to be sorted from the path on the basis of container mold of origin, and providing an electrical signal indicative of such containers. A conveyor is disposed adjacent to the container path downstream of the finished product inspection station, and is responsive to an electronic control signal for selectively removing a container from the path as the container passes adjacent to the conveyor. A timer receives the electrical signal from the inspection station, and applies the electronic control signal to the conveyor after a time delay coordinated with distance between the inspection station and the conveyor, and velocity of travel of containers along the path between the inspection station and the conveyor.

9 Claims, 4 Drawing Sheets

INSPECTION AND SORTING OF CONTAINERS

The present invention is directed to sorting of containers, and more particularly to a method and apparatus for inspecting and sorting molded containers such as glass bottles on the basis of container mold of origin.

BACKGROUND AND OBJECTS OF THE INVENTION

Manufacturing variations in molded containers, such as glass bottles and jars, are often related to variations in the associated molds of origin. For this reason, it is desirable in an automated manufacturing operation having a plurality of molds to possess the ability of identifying a specific molded container with its mold of origin, and of associating container manufacturing variations with molds of origin for repair or replacement purposes. In an automated plant for manufacturing glass bottles, for example, a machine termed an individual section or IS machine includes a multiplicity of mold cavities and automated apparatus for feeding glass gobs to successive molds to blow the containers. The blown containers are then fed by suitable conveying apparatus to a lehr where annealing takes place, and then to a so-called cold end where inspection and sorting are performed prior to packaging of the containers for shipment. In view of the processing delay between the molding and inspection operations, it is desirable to identify potentially defective mold cavities at an early time in order to reduce scrap. In the same way, it is desirable after a mold cavity has been replaced or repaired closely to inspect containers from that cavity in order to certify proper operation.

U.S. Pat. No. 4,413,738 assigned to the assignee hereof discloses a system for one hundred percent inspection of molded containers for sidewall and finish variations, and for automatically sorting containers from mold cavities that are identified as defective. Each container is routed through one of a plurality of multistation inspection devices for automated optical inspection of container sidewall and finish. A primary one of the inspection devices includes or has associated therewith an automated cavity inspection device or CID for reading a code molded onto each container and thereby associating containers passing through that inspection device with molds of origin. A finished product computer correlates variations in containers passing through the primary inspection device to defective molds. All containers are then routed through a second CID at which containers originating at the molds identified as defective by the finished product computer are sorted for rejection.

U.S. Pat. No. 4,691,830, also assigned to the assignee hereof, discloses an automated system for inspecting and sorting molded containers as a function of mold cavity of container origin. In a first system section, finished containers are one hundred percent inspected for variations, and a CID is controlled to reject all containers from cavities associated with defective containers. The CID is also coupled to feed sampled containers from selected cavities to an automatic sampling indexer, in which the sampled containers are fed to one or more stations for testing physical container properties, such as rupture pressure, wall thickness and internal volume. The CID and the automatic sampling indexer are connected to a hierarchy of interconnected computers that receive cavity and test information from the various sections and stations of the system, and control the sampling and sorting process based upon predetermined quality standards. A cavity map is maintained that relates cavity code to physical location of the container-forming machine to help identify quality control trends.

Although the inspection and sorting systems disclosed in the noted patents have enjoyed substantial commercial success and economic benefit in operation, further improvements remain desirable. For example, the disclosed systems embody two cavity inspection devices for reading the mold-of-origin codes on the containers, one at the finished product inspection station, and another at the sampling station at which containers from defective molds are sorted and other containers are sampled for quality control testing. It is desirable to eliminate such redundant inspection of container codes, and it is one object of the present invention to provide a method and apparatus for inspecting and sorting containers in which this goal is accomplished. Another and related object of the present invention is to provide a conveyor system and method for selectively removing containers traveling in sequence along a predetermined path for sample inspection or rejection based upon container mold of origin.

SUMMARY OF THE INVENTION

A system for inspecting and sorting molded containers, such as glass bottles, in accordance with a presently preferred embodiment of the invention includes a finished product inspection station for inspecting containers transported in sequence along a predetermined path, identifying containers to be sorted from the path on the basis of container mold of origin, and providing an electrical signal indicative of each such container. A conveyor is disposed adjacent to the container path downstream of the finished product inspection station, and is responsive to an electronic control signal for selectively removing a container from the path as the container passes adjacent to the conveyor. A timer receives the electrical signal from the inspection station and applies the electronic control signal to the conveyor after a time delay coordinated with distance between the inspection station and the conveyor, and velocity of travel of containers along the path between the inspection station and the conveyor. Containers are thus selectively removed from the transport system as a function of container mold of origin determined at the finished product inspection station, eliminating any need for a second mold cavity inspection device downstream of the inspection station as in the prior art patents discussed above.

The sampling conveyor in accordance with the preferred embodiment of the invention comprises a starwheel turret having circumferentially spaced pockets sized to receive the containers and rotatable about a fixed axis adjacent to the main container transport path. The turret is mounted on a vacuum body that rotates coaxially and conjointly with the turret, and a circumferential array of vacuum cups are mounted on the vacuum body, with at least one vacuum cup being disposed within each starwheel pocket for engaging a container received in such pocket. A circumferential array of valve spools are carried by the vacuum body concentric with and parallel to the axis of turret rotation, with each such spool being disposed in a passage that connects the interior of the vacuum body with the vacuum cup in an associated starwheel pocket. The valve spools are each individually and selectively movable between a first position that blocks application of vacuum at the interior of the vacuum body to the associated vacuum cup and vents the cup to atmosphere, and a second position for enabling application of vacuum through the passage to the associated cup. Thus, when a valve spool is in the first position and the associated vacuum cup is engaged by a container in the associated starwheel pocket, no vacuum is applied to the container through the cup and the container continues to travel in the main transport path. However, when a valve spool is in the second position that enable application of vacuum to the associated cup, a container that engages the cup within the starwheel pocket is effectively grasped by the conveyor and removed from the main transport path.

The valve spools are selectively moved from the first or vacuum-blocking position to the second or vacuum-enabling position by a solenoid actuator that is disposed adjacent to the turret with an armature aligned with the path of the valve spools as the turret rotates. When a container is to be removed from the transport path, an electronic control signal is applied to the solenoid actuator, which moves the valve spool associated with the turret pocket that will receive such container from the first to the second position. A cam is disposed in fixed position adjacent to the turret for engaging the valve spools as they pass in sequence, and moving any valve spools that are in the second or vacuum-applying position to the first or vacuum-blocking position as the valve spools pass the cam, thereby releasing the container grasped by the vacuum cup. Preferably, a second conveyor is disposed adjacent to the turret for receiving containers from the turret removed from the main transport path. The cam is positioned to engage each valve spool and move the valve spool to the first position as the associated vacuum cup and starwheel pocket overlie the second conveyor. A worm conveyor is disposed between the finished product inspection station and the turret in the preferred embodiment of the invention for spacing the containers from each other by a distance corresponding to circumferential spacing between the starwheel pockets.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosures of U.S. Pat. Nos. 4,413,738 and 4,691,830 are incorporated herein by reference for purposes of background.

Figure 1:
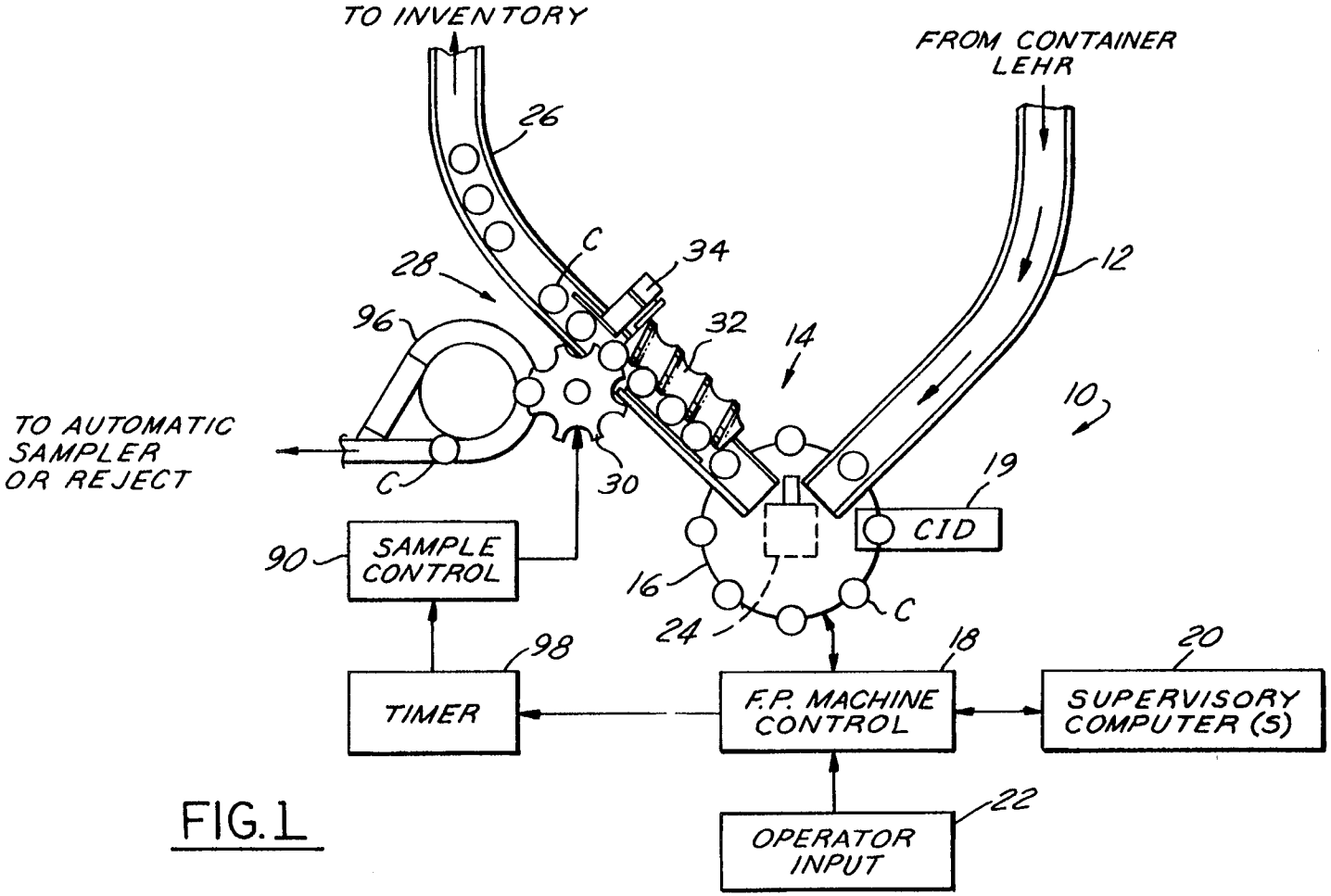
FIG. 1 is a plan view that schematically illustrates a container inspection and sorting system in accordance with one presently preferred embodiment of the invention.

FIG. 1 illustrates an inspection and sorting system 10 in accordance with one presently preferred embodiment of the invention as comprising an in-feed conveyor 12 for transporting containers C from a glass lehr to a finished product inspection system 14. As disclosed in the above-referenced patents, system 14 comprises a starwheel conveyor 16 for transporting sequential containers C through a plurality of circumferentially spaced inspection stations at which the containers are subjected to various inspections. Starwheel 16, as well as the individual inspection stations, are controlled by an FP machine controller 18, which receives inputs from one or more supervisory computers 20, and from an operator input 22 such as a keyboard or the like. The inspection stations of system 14 include one station 19 at which a code molded onto each container is read for associating the container with its mold of origin. A reject actuator 24 at system 14 may remove any containers that fail to pass finish or sidewall inspection. The remaining containers are fed by finish inspection starwheel 16 to an out-feed conveyor 26. To the extent thus far described, system 10 is of generally conventional construction.

U.S. Pat. Nos. 4,175,236, 4,230,219 and 4,230,266 disclose CID's for reading cavity-identifying indicia as a function of rings molded onto the bottoms of the containers. U.S. Pat. No. 4,644,151 and 4,967,070 disclose CID's in which the molds of origin are identified by reading codes manifested by a series of integrally molded bumps or protrusions that extend in an array around the container head. Devices for inspecting the finish, sidewalls, shoulders and/or base of containers are disclosed in U.S. Pat. Nos. 3,160,760, 4,209,387 and 4,601,395 (sidewall inspection), 3,188,743, 3,262,561, 3,313,409, 3,880,750, 3,914,872, 4,278,173, 4,424,441, 4,584,469, 4,701,612, 4,945,228, 4,958,223 and 5,200,801 (finish inspection), and 3,327,849, 4,378,493, 4,378,494, 4,433,785 and 4,608,709 (finish and sidewall inspection). U.S. Pat. Nos. 3,313,409 and 3,757,940 disclose multistation finished product inspection systems, as does U.S. Pat. No. 4,413,738 noted above.

A sampling conveyor 28 in accordance with the present invention is disposed adjacent to out-feed conveyor 26 downstream of inspection system 14. Conveyor 28 includes a starwheel turret 30 having a circumferential array of uniformly spaced concave pockets that are sized or dimensioned to receive containers C as they are conveyed in sequence along out-feed conveyor 26. A worm conveyor 32 is driven by a motor 34 and disposed along conveyor 26 between starwheel turret 30 and system 14 for engaging the sequential containers C and spacing the containers from each other by a distance corresponding to circumferential separation of the pockets in starwheel turret 30.

Figure 2:
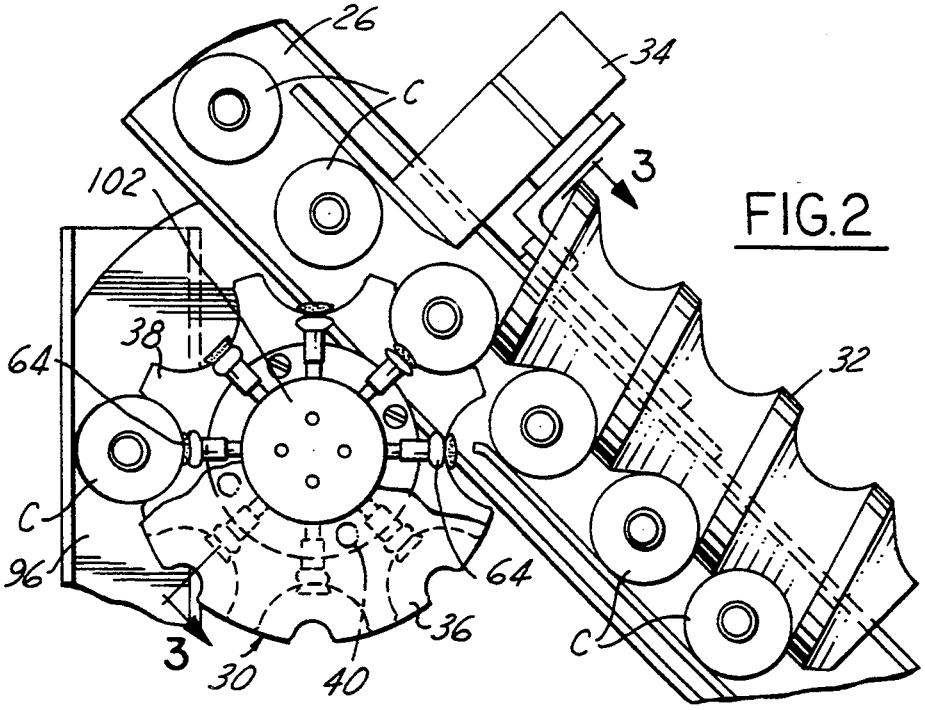
FIG. 2 is a plan view that illustrates a portion of the system of FIG. 1 on an enlarged scale.
Figure 4:
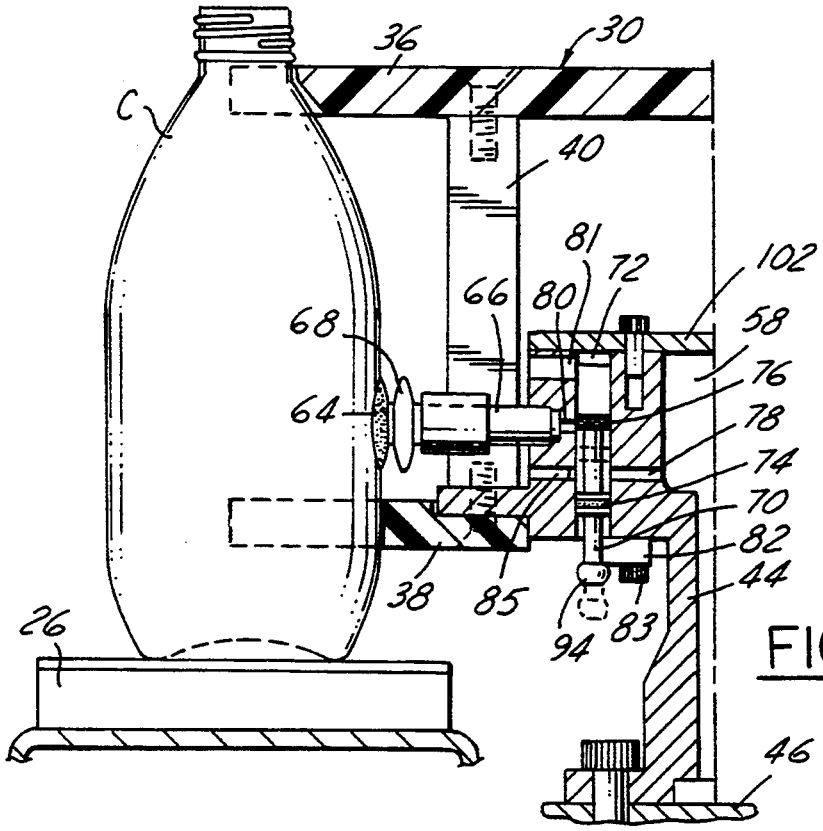
FIG. 4 is a fragmentary view on an enlarged scale of a portion of the system illustrated in FIG. 3.
Figure 3:
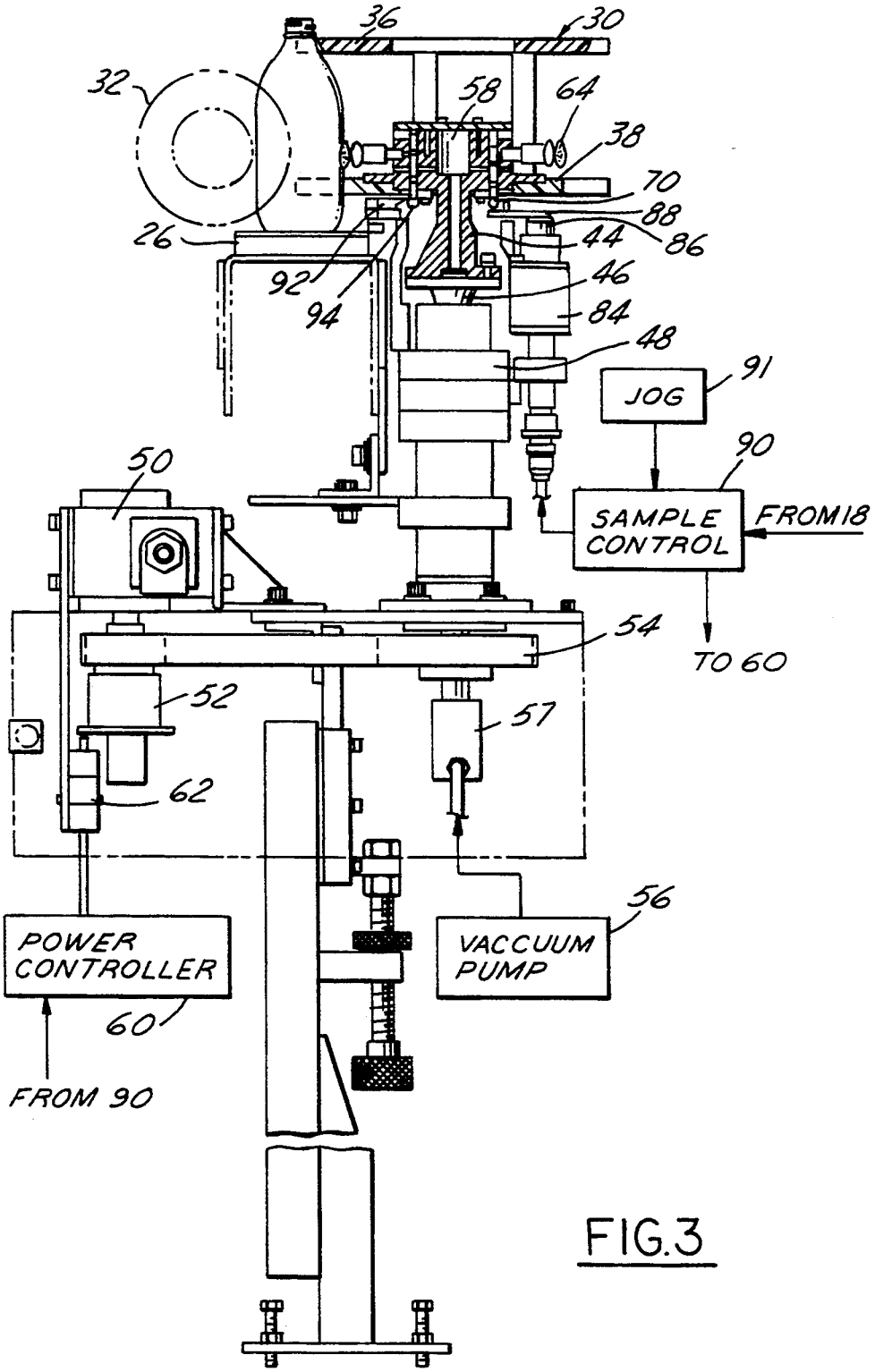
FIG. 3 is a sectioned elevational view of the system in FIG. 1 and 2, being taken substantially the line 3—3 in FIG. 2.

Referring to FIGS. 2–4, starwheel turret 30 comprises an upper starwheel plate 36 and a lower starwheel plate 38 that are fixed to and spaced from each other by four angularly spaced spacer elements 40. Lower starwheel plate 38 is mounted to a flange 42 that radially projects from a vacuum body 44. Vacuum body 44 is mounted on a hollow starwheel driveshaft 46 (FIG. 3), which extends upwardly from a fixed support 48 and is rotated about its fixed axis by a motor (not shown) and a gear box 50, a torque limiter 52 and a drive belt 54. A vacuum pump 56 is connected through a rotary union 57 to the hollow interior of shaft 46 for applying a vacuum to the hollow interior 58 of vacuum body 44 carried by shaft 46. (The term "vacuum" is employed herein to refer to a pressure less than atmospheric pressure.) Thus, turret 30, including parallel starwheel plates 36, 38, turret-supporting vacuum body 44 and driveshaft 46, are rotated coaxially and conjointly by gear box 50 about the fixed axis of the drive shaft and vacuum body. Gear box 50 is controlled by a power controller 60 (FIG. 3) through a switch 62 that is responsive to torque limiter 52 for de-energizing the gear box in the event of excess torque, which may indicate a jam or other fault condition.

A circumferential array of vacuum cups 64 are individually mounted to vacuum body 44 by associated radially oriented pipe fittings 66. Each vacuum cup 64 is disposed within an associated pocket of conveyor 30 so as to engage the outer sidewall surface of a container C that is received within the starwheel pocket. A resilient collar 68 on each cup 64 insures firm sealed engagement of each associated vacuum pocket 64 with the container sidewall. A plurality of valve spools 70 are disposed within associated passages 72 that extend through vacuum body 44 to connect the interior 58 thereof with each individual vacuum cup 64. Each valve spool 70 contains axially spaced O-rings 74, 76 that sealingly engage the surrounding sidewall of passage 72. Seals 74, 76 are axially spaced from each other by a distance that blocks communication from vacuum body interior 58 to the associated vacuum cup 64 in a first position of valve spool 70 illustrated in phantom in FIG. 4. In this position, seal 76 is disposed between passage segment 78 that connects passage 72 with interior 58 and passage segment 80 that connects passage 72 with cup 64. Cup 64 is vented to atmosphere through passage 72 and a radial passage segment 81 that communicates with the upper end of passage 72. A pin 85 blocks passage segment 78 outboard of passage 72.

In the second position of valve spool 70 illustrated in solid lines in FIG. 4, seal 76 is above passage segment 80 while seal 74 is below passage segment 78, so that vacuum cup 64 is connected to interior 58 and vacuum is applied to the vacuum cup. A removable stop 82 is mounted by a screw 83 beneath each passage 72 to prevent removal of spool 82 by engagement with a spool shoulder that surrounds seal 74, and thereby to define the first or vacuum-blocking position of the valve spool. Stop 82 also cooperates with an enlarged head 94 on the end of the valve spool to limit insertion into passage 72, and thereby define the second or vacuum-enabling position of the valve spool as shown in FIG. 4.

A solenoid actuator 84 is mounted on support 48 in fixed position beneath turret 30. Actuator 84 has an actuator arm 86 that moves upwardly in the orientation of FIG. 3 in response to application of an electrical signal to the actuator solenoid. An extension 88 on arm 86 is disposed beneath the circular path of valve spools 70 as the valve spools and vacuum body rotate about the axis of driveshaft 46. Thus, application of an electronic control signal to actuator 84 by sample control electronics 90 urges actuator arm 86 and extension 88 upwardly in the orientation of FIG. 3, so as to push the valve spool 70 aligned therewith upwardly within its associated passage 72 in vacuum body 44 from the vacuum-blocking to the vacuum-enabling position. A cam 92 is mounted on support 48 in fixed position beneath turret 30, and has a camming surface illustrated in FIG. 3 oriented to engage the enlarged end 94 of any valve spools 70 that are in the vacuum-enabling position as turret 30 rotates past cam 92. The surface of cam 92 engages and pulls the end 94 of any such valve spools, so as to pull the valve spools from the vacuum-enabling position shown in solid lines in FIG. 4 to the vacuum-blocking and cup-venting position shown in phantom. In the preferred embodiment of the invention illustrated in FIGS. 1 and 2 in which starwheel conveyor 28 is selectively actuatable to transfer containers C from out-feed conveyor 26 to a sampling conveyor 96, cam 92 (FIG. 3) is so positioned as to release the vacuum applied to the container and vent the vacuum cup to atmosphere when the container overlies conveyor 96—i.e., in the position shown in FIG. 2.

In operation, FP machine controller 18 (FIG. 1) generates an electrical signal upon identification of a container code associated with defective containers or molds, or with a mold selected for sampling, as identified either by inspection, by operator input through keyboard 22 or automated input through supervisory computer 20. When such container has been identified, the electrical signal from FP machine controller 18 is applied to a timer 98, which effectively delays such signal for the time required for the container in question to travel from system 14 to conveyor 28. That is, the time delay imparted by timer 98 is coordinated with velocity of containers in out-feed conveyor 26 and distance between system 14 and conveyor 28 so that the signal is applied to the sample control electronics 90 (FIGS. 1 and 3) at a time coordinated with arrival of the container in question at conveyor 28. When such signal is received, sample controller 90 activates solenoid actuator 84 so as to move the valve spool 70 aligned therewith to the position illustrated in solid lines in FIG. 4 at which vacuum is applied to the associated vacuum cup 64. When the container engages vacuum cup 64 with vacuum so applied thereto, the container is effectively grasped and held by the vacuum cup for removal from conveyor 26 and transfer to conveyor 96. When the container overlies conveyor 96, the valve spool is moved by cam 92 to the vacuum-blocking and cup-venting position illustrated in phantom in FIG. 4 to release the container onto conveyor 96. Of course, if the valve spool 70 is in the vacuum-blocking position when the associated cup 64 engages a container, no vacuum is applied to the container, the container is not grasped, and the container continues to travel along out-feed conveyor 26. Thus, containers identified by FP machine controller 18 are removed from out-feed conveyor 26 while the remaining containers are fed to inventory for storage or shipment, etc. A jog control 91 is coupled to sample control 90 to facilitate set-up and synchronization of turret 30.

Figure 5:
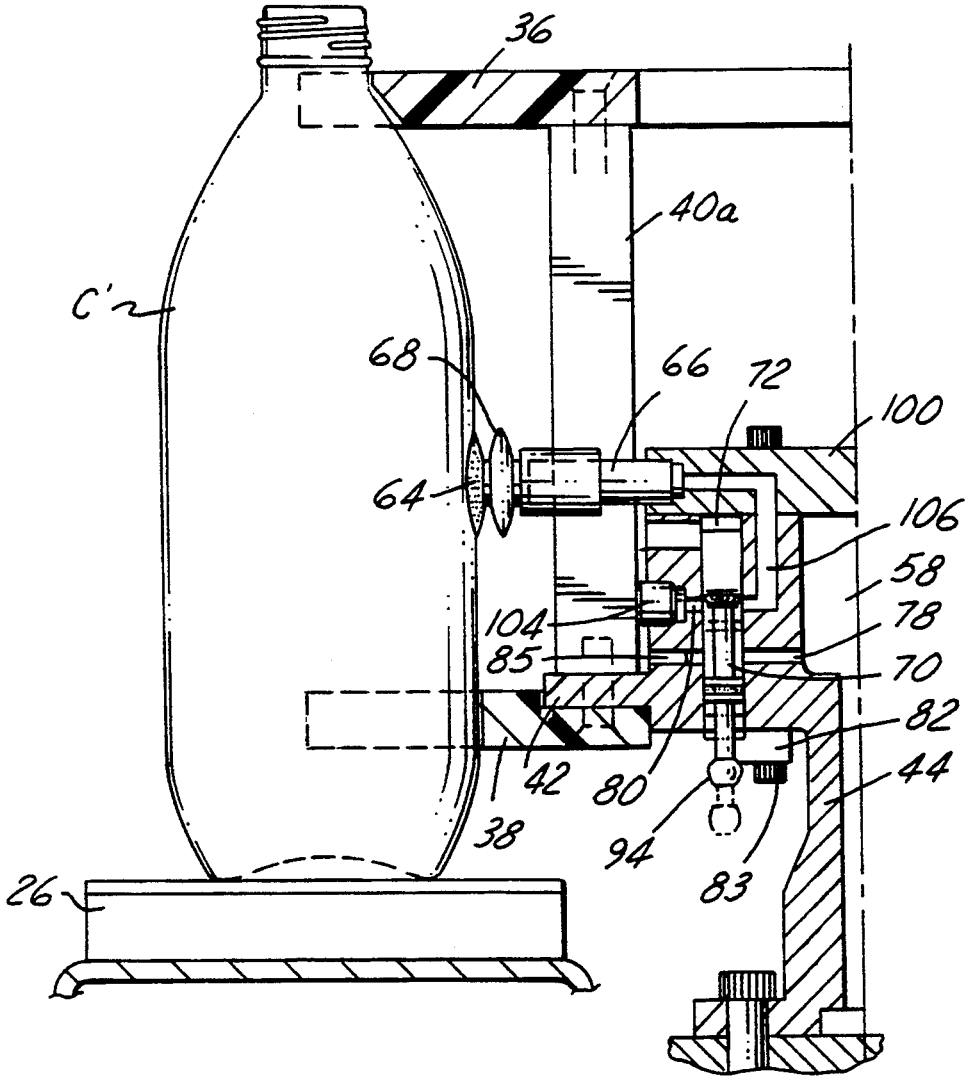
FIG. 5 is a fragmentary elevational view that illustrates a modification to the embodiment of FIG. 4.

FIG. 5 illustrates a modification to FIG. 4 in which a vacuum body extension 100 is mounted on vacuum body 44 in place of the cover 102 illustrated in FIG. 4. Vacuum body passage 80 is blocked by a plug 104, and a passage 106 at the same vertical position as passage 80 extends upwardly through body 44, and thence radially outwardly through extension 100 to pipe fitting 66 and vacuum cup 64. Thus, in the embodiment of FIG. 5, vacuum cups 64 are disposed at a higher elevation than in the embodiment of FIG. 4. Upper starwheel plate 36 is likewise disposed at a higher elevation by the longer spacers 40*a*. The embodiment of FIG. 5 is particularly useful in connection with taller containers C'.

We claim:

1. A system for inspecting and sorting containers comprising:

first conveyor means for transporting containers in sequence along a predetermined path, means for inspecting containers traveling in said path, identifying containers to be sorted from said path and providing an electrical signal indicative thereof, a starwheel turret having circumferentially spaced pockets sized to receive the containers, means for rotating said turret about a fixed axis adjacent to said path downstream of said inspecting means, a vacuum body rotatable conjointly and coaxially with said starwheel turret, a plurality of resilient vacuum cups mounted in a circumferential array on said vacuum body within said pockets, a plurality of passage means in said vacuum body individually operatively coupled to said cups and opening at one end of said vacuum body, vacuum means coupled to said vacuum body for applying a vacuum to all of said passage means, a plurality of valve spools each disposed in an associated one of said passage means, each of said valve spools having a first enlargement within said passage means for sealingly engaging said passage means and a second enlargement disposed outside of said passage means, and a plurality of stop means carried by said vacuum body each externally adjacent to the open end of an associated one of said passage means between said first and second enlargements on said spools and cooperating with said first and second enlargements to define a vacuum-blocking position of said valve spool when said first enlargement is in abutment with the associated said stop means for blocking application of vacuum to the associated cup and a vacuum-enabling position of said valve spool when said second enlargement is in abutment with said stop means for applying a vacuum to the associated cup and thereby holding a container within the associated starwheel pocket, means disposed adjacent to said turret and responsive to an electronic control signal for engaging a valve spool and moving such spool from said vacuum-blocking position to said vacuum-enabling position, and timing means responsive to said electrical signal from said inspecting means for applying said electronic control signal to said signal-responsive means after a time delay coordinated within distance and velocity of travel of containers along said path between said inspecting means and said turret.

2. The system set forth in claim 1 wherein each of said plurality of stop means comprises a stop block and means for removably mounting said stop block adjacent the open end of an associated said passage means to cooperate with said first and second enlargements and capture said spool on said vacuum body when the stop block is mounted on said vacuum body, and to permit removal of the valve spool from said vacuum body for maintenance and repair when the stop block is removed from said vacuum body.

3. The system set forth in claim 2 further comprising means disposed in fixed position adjacent to said turret for engaging said second enlargements of said valve spools as they pass in sequence and moving any valve spools that are in said vacuum-enabling position back to said vacuum-blocking position, in which said first enlargement in abutting engagement with said stop means.

4. The system set forth in claim 3 wherein said means responsive to said electronic control signal comprises a solenoid actuator.

5. The system set forth in claim 4 wherein said means for engaging said valve spools comprises valve spool cam means for engaging said second enlargement on each spool in said vacuum-enabling position and moving such spool to the vacuum-blocking position with said first enlargement in engagement with said stop means.

6. The system set forth in claim 5 further comprising second conveyor means disposed adjacent to said turret for receiving containers from said turret removed from said path, said cam means being positioned to engage each said valve spool and move the spool to said vacuum-blocking position as the associated vacuum cup and pocket overlie said second conveyor means.

7. The system set forth in claim 2 wherein said first conveyor means further comprises a worm conveyor disposed between said turret and said inspecting means along said path for spacing containers from each other by a distance corresponding to circumferential spacing between said pockets.

8. The system set forth in claim 2 in which each container is a molded container and has readable indicia thereon indicative of mold of origin, and wherein said inspecting means identifies containers to be sorted by said first conveyor means as a function of such indicia.

9. The system set forth in claim 8 Wherein said inspecting means includes input means for identifying to said inspecting means mold indicia to be sorted at said first conveyor means.

* * * * *